US006381888B1

(12) United States Patent
Törnqvist

(10) Patent No.: US 6,381,888 B1
(45) Date of Patent: May 7, 2002

(54) DEVICE FOR CHANGING ELONGATED OBJECTS

(75) Inventor: Peter J. T. Törnqvist, Lidingö (SE)

(73) Assignee: Iwarson & Kotton Exposense AB, Göteborg (SE)

( * ) Notice: Subject to any disclaimer, the term of this patent is extended or adjusted under 35 U.S.C. 154(b) by 0 days.

(21) Appl. No.: 09/125,418

(22) PCT Filed: Feb. 26, 1997

(86) PCT No.: PCT/SE97/00322

§ 371 Date: Aug. 17, 1998

§ 102(e) Date: Aug. 17, 1998

(87) PCT Pub. No.: WO97/32294

PCT Pub. Date: Sep. 4, 1997

(30) Foreign Application Priority Data

Feb. 27, 1996 (SE) ..... 9600746

(51) Int. Cl.[7] ..... G09F 11/08; G09F 11/30
(52) U.S. Cl. ..... 40/498; 40/499
(58) Field of Search ..... 40/499, 498, 475, 40/493, 379

(56) References Cited

U.S. PATENT DOCUMENTS

| | | | | | |
|---|---|---|---|---|---|
| 375,987 | A | * | 1/1888 | Castle | 40/498 |
| 452,398 | A | * | 5/1891 | Swartz | 40/499 |
| 634,248 | A | * | 10/1899 | Sonneborn et al. | 40/499 |
| 738,914 | A | | 9/1903 | Jordan | |
| 815,078 | A | | 3/1906 | Downey | |
| 4,240,219 | A | | 12/1980 | Tornqvist | |
| 4,658,524 | A | | 4/1987 | Jackson et al. | |

FOREIGN PATENT DOCUMENTS

| | | | | |
|---|---|---|---|---|
| GB | 12641 | * | 9/1888 | 40/499 |
| SE | 7303560-2 | | 8/1976 | |

* cited by examiner

*Primary Examiner*—Cassandra H. Davis
(74) *Attorney, Agent, or Firm*—Frishauf, Holtz, Goodman, Langer & Chick, P.C.

(57) ABSTRACT

A device for successively changing elongated flexible sheets or similar flexible objects from an active position to non-active positions includes a drum, relative to which the sheets or similar flexible objects are fixed. The drum is rotatable in two opposing rotational directions. The rotational directions of the drum are controlled by a timing device in relation to the rotational speed of the motor so that rotation takes place in a first direction for such a time that the sheet located in the active position becomes wound up onto the drum and that a second sheet, located in the first rotational direction after the first sheet, is carried to a position from which the second sheet is unwound from the drum to the active position, upon rotation of the drum in the other rotational direction. Thereafter the drum is rotated in the other rotational direction for such a time that the second sheet becomes unwound from the drum. The rotation of the drum is subsequently stopped by the suitable timing device during such a time as is wanted in the active position for the second sheet. The timing procedure is repeated after the wanted time in the active position.

21 Claims, 3 Drawing Sheets

DEVICE FOR CHANGING ELONGATED OBJECTS

TECHNICAL FIELD

The present invention relates to a device for successively changing elongated flexible sheets or similar flexible objects from an active position to non-active positions. The device incorporates a drum, relative to which the sheets or similar flexible objects are fixed in a suitable manner. The said drum is rotatable by means of a motor.

BACKGROUND INFORMATION

Devices for changing posters or similar objects are known in a number of more or less complicated embodiments. The known devices are usually of complicated design and many of them are also difficult and awkward with regard to changing posters for new ones. Apart from high complexity known devices have the disadvantage that they are expensive to make.

Examples of such known devices are evident from, i.a., the Swedish patent specification No. 7303560-2 and the U.S. Pat. No. 4,240,219.

OBJECT OF THE INVENTION AND SUMMARY

An object of the present invention is to provide a device for changing posters or similar elongated flexible objects which device is simple and inexpensive to manufacture and assemble, which has a simple and reliable function, with which it is easy for a layman to change posters etc: and which above all requires a minimum of maintenance and service.

The above tasks and objects have been solved in accordance with the present invention by means of the device mentioned in the descriptive preamble in that the drum is rotatable in two opposing rotational directions, that the rotational directions of the drum are controlled by means of a suitable timing device in relation to the rotational speed of the motor so that rotation takes place in a first direction for such a long time that the sheet located in the active position becomes wound up onto the drum and that a second sheet, located in the first rotational direction after the first sheet, is carried to a position from which the second sheet is unwound from the drum to the active positions upon rotation of the drum in the other rotational direction, and in that the drum thereafter is rotated in the other rotational direction for such a long time that the second sheet becomes unwound from the drum, and in that the rotation of the drum is subsequently stopped by the suitable timing device during such a long time as is wanted in the active position for the second sheet, and in that the aforesaid timing procedure is repeated after the wanted time in the active position.

A particularly advantageous embodiment of the present invention is if the elongated flexible sheets or the similar flexible objects are fixed, either directly or indirectly, in relation to the preferably round drum at essentially the same mutual distances and if the number of used, elongated flexible sheets or similar flexible objects agree with the number of switching of the said motors rotational direction during rotation of the drum one revolution.

BRIEF DESCRIPTION OF THE DRAWINGS

The present invention will be described in greater detail hereinbelow, with particular reference to an embodiment chosen by way of example and with particular reference to the accompanying drawing, wherein.

DETAIL DESCRIPTION OF THE INVENTION

Figures 1, 4:
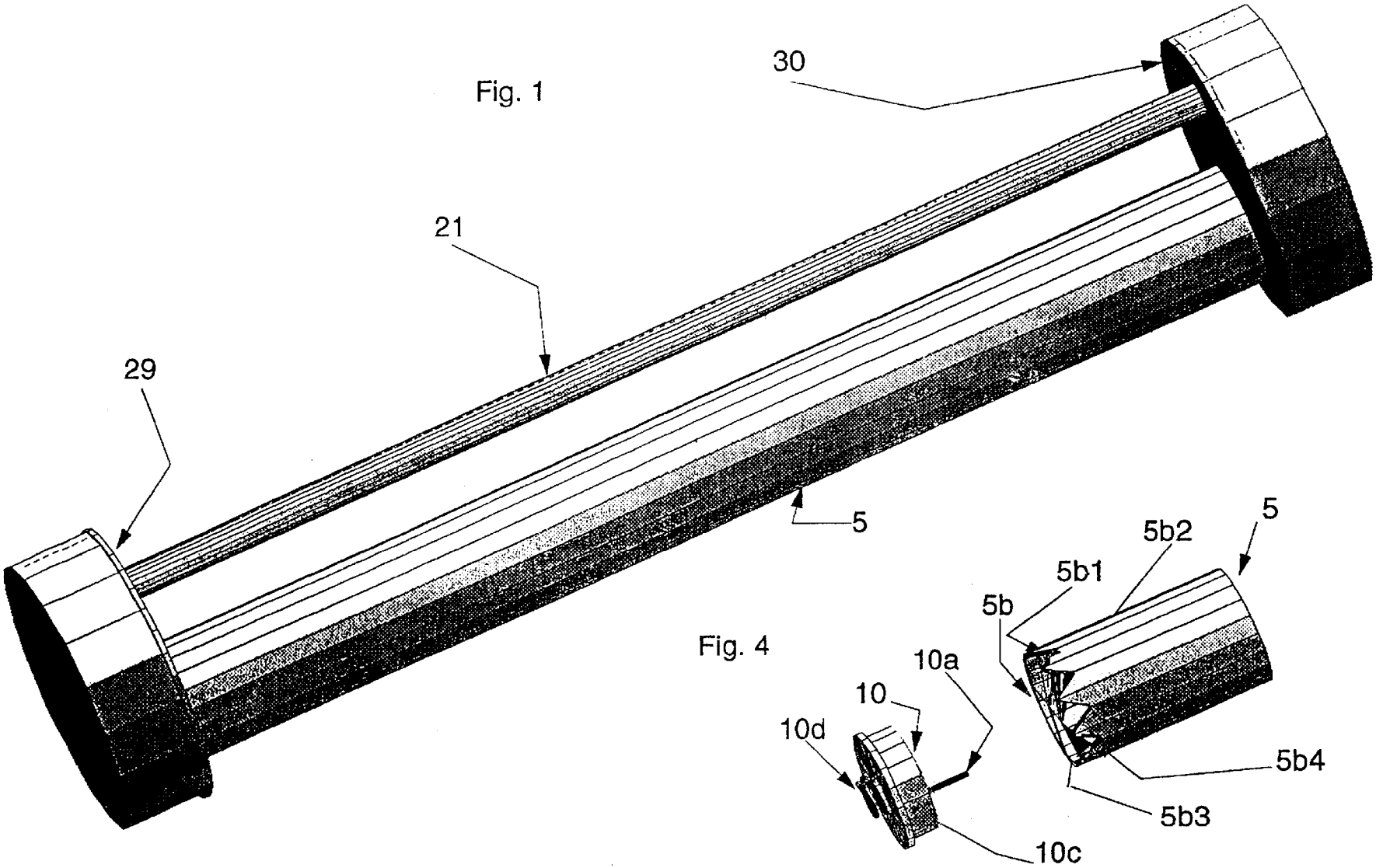
FIG. 1 shows a perspective view of an embodiment chosen by way of example of the device according to the invention with posters or other elongated objects removed.
FIG. 4 shows a variant of the setting as will become more apparent herein below.
Figure 3:
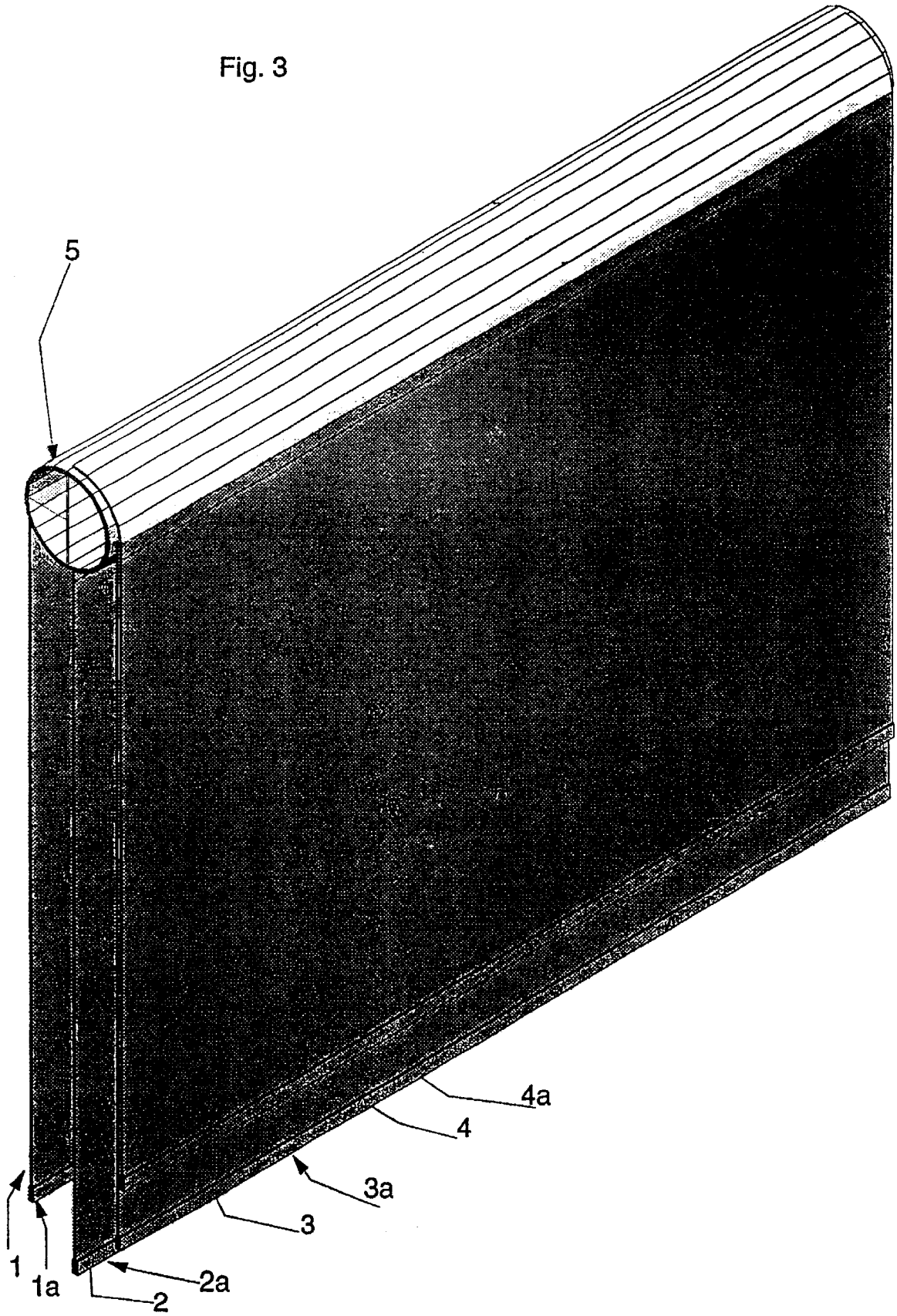
FIG. 3 shows one part of the device according to FIG. 1 with posters applied.

The device according to FIG. 1 incorporates a drum 5 with thereon applied posters or similar elongated objects 1–4, see especially FIG. 3. The number of posters or similar can vary from two and upwards. In the example shown in FIG. 3 four posters are used. The posters or similar elongated objects 1–4 are fixed in relation to the drum preferably at the same mutual distances around the periphery of the drum, this being achievable in several ways, for example a flexible carrier can be furnished with taped-on posters at a mutually fixed distance, the said carrier subsequently for example being taped or secured to the drum 5. Alternatively each posters can be fixed with tape relative to the drum. Obviously there are a large number of other possibilities for securing the posters relative to the drum. For example the drum can be furnished with grooves in which folded over, relatively stiff ends of the posters can be inserted and thereby fixed, or the posted can be clamped on by means of devices suitable for the purpose and not shown on the drawings.

The posters 1–4 are provided in the lower ends—if necessary—with weights 2*a*–4*a* to stretch out the posters, see especially FIG. 3.

Figure 2:
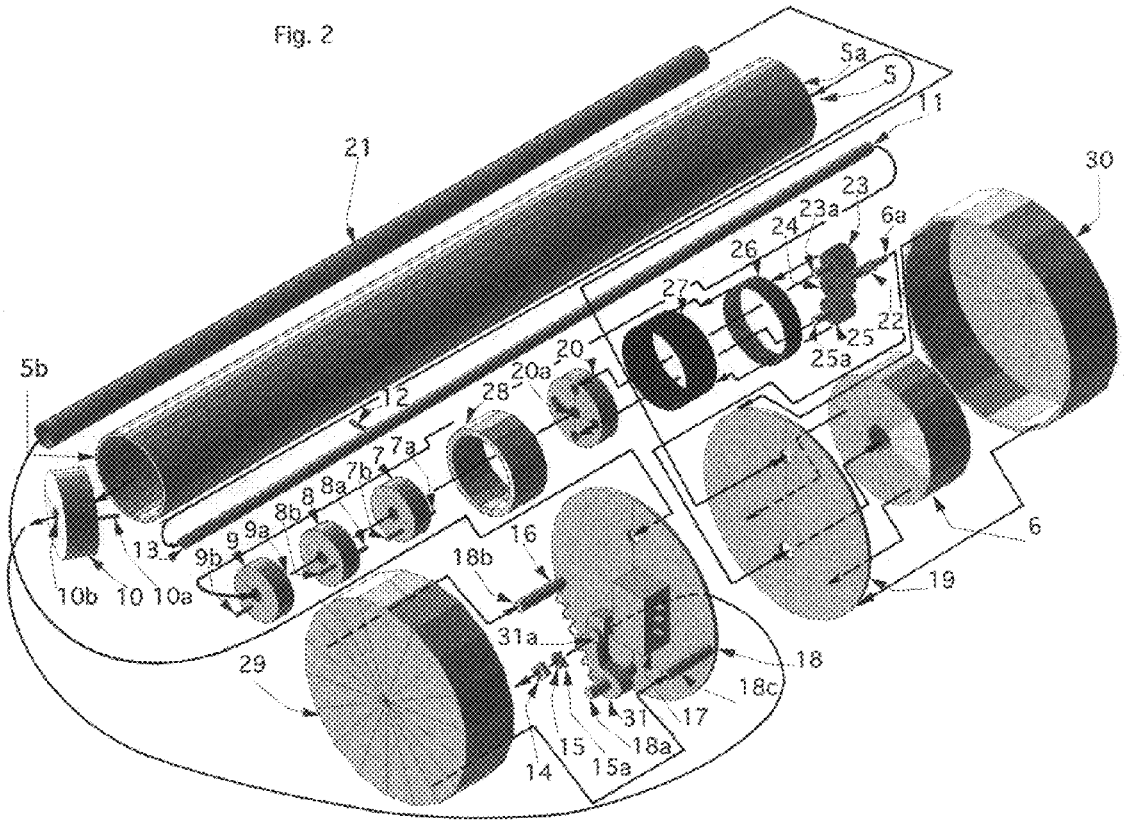
FIG. 2 is an exploded view of the device according to FIG. 1 and with the parts placed mutually separated and additionally redirected in some cases to clarify the same.

This drum 5 is rotated in its turn around its central axis in two opposing rotational directions by means of a device suitable for this purpose, preferably an electrically powered motor 6, see FIG. 2. Switching of the rotational direction for the motor 6 and thereby for the drum 5 is governed by a time circuit which can consist either of any suitable electric circuit available in the marketplace with suitable relays, contactors, a computer control etc., or of a well attuned mechanical circuit which as a detailed example is described more closely hereinbelow.

A description of changing of posters is made with reference to FIG. 3, where poster 1 is shown situated in the active position, for example in the display position with an active displace of the poster 1 turned in towards the plane of the paper and/or located in the viewing direction, essentially covering behind located posters. Upon the said rotation of the drum 5 in the anti-clockwise direction all posters 1–4 or the like are wound up simultaneously and together onto the drum 5. This rotation in the anti-clockwise direction takes place during such a long time that all posters 1–4 have been wound up and that the next poster 4 in the rotational direction of the drum and primarily its weight 4*a* has passed over the uppermost point of the drum 5, which, however, the weight 3*a* of the poster 3 following after poster 4 has not done. Thereafter the rotational direction of the drum 5 is switched with the of the motor 6 of the said time circuit, whereby the posted 4 is unwound completely from the drum 5 to the active display position further in towards the place of the paper which was previously occupied by poster 1. Obviously the ends of the posters 1–4 and their positions can be controlled by some other means in order to control switching of rotational direction, whereof by way of example mention may be made of a light curtain or an electric switch, which can react to passage of the rear edge of each poster or its associated weight. By this means changing from poster 1 to poster 4 has taken place in the display position. The rotation of the drum 5 is then caused with aid of the said time circuit to cease during such a long time as it is desired to display the said poster 4 in the active display position, whereafter the process above is repeated with rotation of the drum 5 in the anti-clockwise direction. Switching of rotational direction takes place when poster 3 and primarily its weight 3*a*—or the rear edge of the poster, viewed in the rotational direction—but not weight 2*a*—has passed over the uppermost point of the drum 5, whereafter the rotational direction of the motor 6 of the said time circuit and thereby of the drum 5 is switched the process is repeated, etc., etc.

As an example of an alternative to using a weight as above mention may be made of a dolly roller which presses against the drum 5 and thereby against the wound posters.

In the text use is made of the expression posters and in the present context this expression also relates to other times of elongated flexible objects than posters, for example flexible felts, awnings, fabrics, carpets, wallpapers, roller blinds, rolling doors, sluices etc.

The drum 5 according to FIG. 2 is rotatably arranged relative to two end plates 18 and 19, located near the respective ends 5*b* and 5*a* of the drum 5 and relative to a shaft 11 by means preferably of an appropriately electrically powered motor 6 attached to one end plate 19, the rotational direction of the said motor 6 being switchable by means of an electric switch 17 which—via electrical wiring not shown in FIG. 2 running from the switch 17 via the interior of a tube 21 to the motor 6—reverses the rotational direction of the motor 6. The tube 21 fixes the end plates 18 and 19 at a mutual distance which slightly exceeds the extent of the drum 5 in the same direction, enabling the drum 5 to rotate freely between the end plates 18 and 19.

The shaft 11 is rotated by the outgoing shaft 6*a* of the motor 6, which is driven preferably via a threaded-on spring 22', which evens out certain unevenness in the running of the motor. This rotation of the shaft 11 takes place via first gearwheel 24, via two additional gearwheels 23 and 25, a gear rim 26 and a ring 27 joined together with the latter, and via a bearing bracket 20 for the shafts 23*a* and 25*a* of gearwheels 23 and 25, in the centre 20*a* of the said bearing bracket 20 the shaft 11 is fixed. For supporting effect for bearing bracket 20 there is proved a sleeve 28 pressed onto the ring 27 or formed with the latter, which sleeve 28 is located on its outer surface close to the inside of the drum 5 and on its inner surface is located near the bearing bracket 20. It must nevertheless be emphasised that the drum 5 runs freely in relation to the sleeve 28 and the latter can advantageously be elaborated as a bearing surface. All the above driving ports for the shaft 11 are located inside the drum 5 and close to one end 5*a* of the drum. If so desired or needed the drive motor 6 for example and other parts can be located inside the drum 5.

Close to the other end 5*b* of the drum 5 on the rotating shaft 11 is a first driver 12, fixed in the shaft 11 straight across the same, and an appropriate number of blocks 7–9 passed onto the shaft 11 and rotatably arranged relative to the shaft 11, each of which blocks is provided with an associated, attached or integrated driver 7*a*, 7*b*; 8*a*, 8*b*; 9*a*, 9*b*, which are placed at the same distance from the centre of the shaft 11. The number of such blocks may be varied, depending on the time requires in the active position or display position. A larger number of such drives provides a possibility for a longer exposure time.

The distance which agrees essentially with the distance between the driver 12 and a threaded portion 13 applied to the outer end of the shaft 11 corresponds largely to the distance between the blocks 7–9 so that the first driver 12 on certain occasions interacts with driver 7*a* on the block 7, driver 7*b* interacts on certain occasions with driver 8*a*, driver 8*b* interacts on certain occasions with driver 9*a*, driver 9*b* interacts on certain occasions with a further driver 10*a*, which is applied in a driver end plate 10 inserted into the other end 5*b* of the drum 5 and fixed in a suitably way at the same distance from the centre of the shaft 11 as the other drivers 7*a*, 7*b*, 8*a*, 8*b*, 9*a*, 9*b*. The driver end plate 10 is in this instance fixed relative to the drum 5. It should be noted here that the said driver end plate 10 has been shown in FIG. 2 slightly turned in relation to other parts in order for the further driver 10*a* to be clearly apparent in the otherwise shown, mainly perspective view. The centre hole 10*b* of the driver end plate 10 affords a bearing surface for the shaft 11, whereby the drum 5 is rotatable relative to the shaft 11.

The shaft 11 continues through the end plate 18 with the threaded portion 13 of the shaft 11. Threaded onto this threaded portion 13 is first a nut 15 provided with a stop screw 15*a*, the position of the said nut thus being fixed relative to the threaded portion 13 of the shaft 11 and then a nut 14 which in this instance is square. With a different number of posters or similar than four, for example when using 3 posters, the nut 14 is elaborated triangular, when using five posters the nut is made five-sided, etc.

This angular nut 14 is arranged to lift in one position—determined by the screw 15 provided with the stop nut 15*a*—a lever 31 provided with a stop 31*a*, which lever in turn activates the electrical switch 17 or a reverser not shown on the drawing to shift the rotational direction of the shaft 11. The switch 17 is fixed in the end plate 18 and the lever 31 is movably located on a shaft 18*a*, which also together with 18*b* and 18*c* can comprise spacing means for a cover hood 29. The spacing means 18*b* and especially the portion located closet to the end plate 18 also comprises a fastener for one end of a spring 16, the other end of which is secured in the lower part of the lever 31, whereby the lever 31 is caused by the said spring 16 both to rotate around the shaft 18*a* in its upper part in the clockwise direction and also to tend to be moved in the direction towards the end plate 18 along the shaft 18*a*.

The shaft 11 rotates clockwise according to FIG. 2, whereupon the threaded portion 13 rotates in the nut 14. This is prevented from rotating in that its side bears against the inner surface of the lever 31—parallel with the shaft 11. The nut 14 is moved outwards—from the end plate 18—until its outer side reaches a limiting wall 31*a* on the lever 31. By positioning the limiting wall 31*a* at different axial distances different exposure times are obtained. When the nut 14 continues its outward movement the lever 31 is thereby caused to be moved outwards. Upon a certain movement the upper plane of the lever 31 leaves the operating button of the switch 17, which button was previously pressed in on account of the influence of the lever 31 and the spring 16. The operating button of the switch 17, which is spring-loaded outwards, is now permitted momentaneously to move outwards with the result that the shaft 11 now switches rotational direction and rotates anti-clockwise.

The nut 14 and the lever 31 are now moved inwards—due to the influence of the spring 16—until the inner side of the upper part of the lever 31 reaches the side of the operating button of the switch 17, whereupon the lever 31 discontinues its inward movement. The nut 14 continues its inward movement until it reaches the nut 15 and is caused by the nut 15 to rotate in the anti-clockwise direction. By this means the lever 31 is turned until its side edge 31*a* passes the operating button of the switch 17 and then especially past is surface which is located farthest away from the switch 17. The spring 16 is now enabled to move the lever 31 inwards past and over the operating button of the switch 17. The nut 14 continues its anti-clockwise rotation. When the edge of the nut 14 has passed the uppermost point of the lever 31—has turned through 90° in this example where a square nut is used—the lever 31 is enabled on its surface resting against the nut 14—due to the influence of the spring 16—to rotate distinctly clockwise and press in the operating button of the switch 17 so that the shaft 11 assumes a reverse rotational direction and again rotates clockwise, whereupon the procedure is repeated.

The parts in the shown embodiment which in the drawings are shown to be located outside the drum 15 can—if necessary and if so wanted—be instead located inside the said drum 5.

Illustrated in FIG. 4 is a somewhat different drum 5 with an associated driver end plate 10. In this embodiment the end 5*b* of the drum has been provided with a plurality of notches or grooves 5*b*1, 5*b*2, 5*b*3, 5*b*4, etc. and the driver end plate 10 has been provided with a protruding pin 10*c*. Further a spring 10*d* acts between the end plate 18 not shown in FIG. 4 and the driver end plate 10, pressing the latter against the end 5*b* of the drum 5. By this means the pin 10*c* is forced to interact With one of the notches 5*b*1, 5*b*2, etc. The position of the driver 10*a* is changed by resetting this pin 10*c* against the action of the spring 10*d*. Because of this the position of the nut 15 fitted with stop screw 15*a* is of less importance and an easily performed adjustment has been accomplished. The stop screw 15*a* can even be dispensed with in such an embodiment. It should also be noted that the number of notches 5*b*1, 5*b*2, etc. is not critical but on the other hand they should preferably comprise slightly more than 90° when a square nut 14 is used, slightly more than 120° when a triangular nut 14 is used, etc.

What is claimed is:

1. A device for successively changing sheets (1–4) from an active position to non-active positions comprising a plurality of elongated flexible sheets and a drum (5) operatively coupled to a motor and being rotatable by means of said motor (6), wherein said drum (5) is rotatable in two opposing rotational directions, the rotational direction of said drum (5) being controlled by a timing device having a timing procedure in relation to a rotational speed of the motor (6) so that rotation takes place in a first direction for such a time that one of said sheets (1) located in the active position becomes wound up onto the drum and such that a second of said sheets (4) is carried to a position from which said second sheet (4) is unwound from the drum (5) to the active position, upon rotation of said drum (5) in the other rotational direction, and in that said drum (5) thereafter is rotated in the other rotational direction for such a time that the second sheet (4) becomes unwound from the drum (5), and such that the rotation of the drum (5) is subsequently stopped by the timing procedure during such a time as is wanted in the active position for the second sheet (4), and in that the timing procedure is repeated after the wanted time in the active position.

2. A device as claimed in claim 1, wherein said motor is an electrically powered motor (6), and wherein the timing device comprises an electric time control circuit with associated relays, and contactors for control of said motor (6).

3. A device as claimed in claim 2, characterized in that the elongated flexible sheets (1–4) are fixed at least indirectly to the drum (5) at essentially the same mutual distances.

4. A device as claimed in claim 2, characterized in that the plurality of elongated flexible sheets (1–4) corresponds to a number of reswitchings of the rotational directions of the said motor (6) during rotation of the drum (5) through one revolution.

5. A device as claimed in claim 2, characterized in that the said elongated flexible sheets (1–4) are mounted at a mutual distance on a carrier which in turn is arranged to be fixed in relation to the drum (5).

6. A device as claimed in claim 2, characterized in that at least said timing device is located inside said drum (5).

7. A device as claimed in claim 1, wherein said motor is an electrically powered motor (6), and wherein the timing device comprises a mechanically acting time control circuit which controls the rotational direction of said motor (6).

8. A device as claimed in claim 7, characterized in that the elongated flexible sheets (1–4) are fixed at least indirectly to the drum (5) at essentially the same mutual distances.

9. A device as claimed in claim 7, characterized in that the plurality of elongated flexible sheets (1–4) corresponds to a number of reswitchings of the rotational directions of the said motor (6) during rotation of the drum (5) through one revolution.

10. A device as claimed in claim 7 characterized in that the said elongated flexible sheets (1–4) are mounted at a mutual distance on a carrier which in turn is arranged to be fixed in relation to the drum (5).

11. A device as claimed in claim 7, characterized in that at least said timing device is located inside said drum (5).

12. A device as claimed in claim 7, wherein the mechanically acting time control circuit comprises a mechanical circuit (7–10, 11–16) which controls the wanted time of the said active position and which is arranged to actuate an electric switch (17), which is arranged to change the rotational direction of the said motor (6).

13. A device as claimed in claim 12, characterized in that the elongated flexible sheets (1–4) are fixed at least indirectly to the drum (5) at essentially the same mutual distances.

14. A device as claimed in claim 12, characterized in that the plurality of elongated flexible sheets (1–4) corresponds to a number of reswitchings of the rotational directions of the said motor (6) during rotation of the drum (5) through one revolution.

15. A device as claimed in claim 12 characterized in that the said elongated flexible sheets (1–4) are mounted at a mutual distance on a carrier which in turn is arranged to be fixed in relation to the drum (5).

16. A device as claimed in claim 12, characterized in that at least said timing device is located inside said drum (5).

17. A device as claimed in claim 1, wherein the elongated flexible sheets (1–4) are fixed, at least indirectly, to the drum (5) at essentially the same mutual distances.

18. A device as claimed in claim 1, wherein the plurality of elongated flexible sheets (1–4) coincides with a number of reswitchings of the rotational directions of said motor (6) during rotation of the drum (5) through one revolution.

19. A device as claimed in claim 1 wherein said elongated flexible sheets (1–4) are mounted at a mutual distance on a carrier which in turn is arranged to be fixed in relation to the drum (5).

20. A device as claimed in claim 1 wherein at least said timing device is located inside said drum (5).

21. A device for successively changing sheets (1–4) from one active position to non-active positions comprising a drum (5) operatively coupled to a motor and being rotatable by means of said motor (6), wherein said drum (5) is rotatable in two opposing rotational directions, the rotational direction of said drum (5) being controlled by a timing procedure in relation to a rotational speed of the motor (6) so that rotation takes place in a first direction for such a time that one of a plurality of elongated flexible sheets (1) located in the active position becomes wound up onto the drum and such that a second of said plurality of elongated flexible sheets (4) is carried to a position from which said second sheet (4) is unwound from the drum (5) to the active position, upon rotation of said drum (5) in the other rotational direction, and in that said drum (5) thereafter is rotated in the other rotational direction for such a time that the second sheet (4) becomes unwound from the drum (5), and such that the rotation of the drum (5) is subsequently stopped by the timing procedure during such a time as is wanted in the active position for the second sheet (4), and in that the timing procedure is repeated after the wanted time in the active position.

* * * * *